United States Patent [19]

Kennedy et al.

[11] 4,419,253

[45] Dec. 6, 1983

[54] SYNTHETIC POST-PICKLE FLUID

[75] Inventors: Carl S. Kennedy, Dyer; Theodore A. Hack, Munster, both of Ind.

[73] Assignee: Nalco Chemical Company, Oak Brook, Ill.

[21] Appl. No.: 318,974

[22] Filed: Nov. 6, 1981

[51] Int. Cl.[3] ..... C10M 3/18; C10M 3/26

[52] U.S. Cl. ..... 252/34.7; 252/49.3; 252/56 D; 252/51.5 A; 252/56 R

[58] Field of Search ..... 252/34.7, 49.3, 51.5 A, 252/57, 56 D, 389 R

[56] References Cited

U.S. PATENT DOCUMENTS

| | | | |
|---|---|---|---|
| 3,006,849 | 10/1961 | Plemich | 252/34.7 |
| 3,630,898 | 12/1971 | Teeter et al. | 252/34.7 |
| 3,769,214 | 10/1973 | Davis | 252/34.7 |
| 3,897,349 | 7/1975 | Marin et al. | 252/34.7 |
| 4,379,072 | 4/1983 | Yarham et al. | 252/389 R |

*Primary Examiner*—Jacqueline V. Howard
*Attorney, Agent, or Firm*—Keil & Witherspoon

[57] ABSTRACT

The present invention discloses a synthetic post-pickle fluid composition which is useful for treating metal to provide corrosion resistance and act as a lubricant for further metal processing. In the preferred embodiment, the composition contains an aqueous solution of a base and a carboxylic acid. The composition may also include fatty acids, viscosity controllers, i.e., thickeners, extreme pressure additives, and optionally may include a chelating agent. In a second embodiment, the composition contains an aqueous solution of a base and a fatty acid at more then 7 percent of the total composition. Examples of suitable bases include potassium hydroxide, monoethanol amine and diethanolamine. Examples of suitable carboxylic acids are the aromatic carboxylic acids and $C_{4-16}$ dibasic carboxylic acids. The composition has a basic pH.

11 Claims, No Drawings

SYNTHETIC POST-PICKLE FLUID

BACKGROUND OF THE INVENTION

The present invention relates to a composition, referred to herein as a synthetic post-pickle fluid, which is useful for treating metal to provide corrosion resistance to the metal surface as well as to act as a lubricant in subsequent processing of the metal. The particular synthetic composition of this invention is generally applied as a post-pickling fluid, i.e., a post acid-pickling fluid.

As is generally known, various pickling baths are used to condition the surface of metal, including the removal of various oxides, rust or scale and various surface contaminants on the metal. Acid pickling baths are generally utilized to remove scale, oxides and other impurities. However, alkaline sequestrants or molten alkalai may also be utilized. Once the metal has been treated to remove the scale, oxides and other impurities, it is desired to treat the metal with a composition which will provide corrosion resistance to the metal and which will act as a lubricant during processing of the pickled metal. In this manner it is possible to store the pickled metal until the time of processing without the need to re-pickle the metal. The treated metal will also have improved corrosion resistance after it has been further processed. It is an object of the present invention to provide a synthetic composition which imparts corrosion resistance to metal which has been treated with it. It is a further object of the present invention to provide a synthetic composition which will also function as a lubricant in further processing of the treated metal.

SUMMARY OF THE INVENTION

The present invention discloses a synthetic post-pickle fluid composition which is useful for treating metal to provide corrosion resistance and act as a lubricant for further metal processing. In the preferred embodiment, the composition contains an aqueous solution of a base and a carboxylic acid. The composition may also include fatty acids, viscosity controllers, i.e., thickeners, extreme pressure additives, and optionally may include a chelating agent. In a second embodiment, the composition contains an aqueous solution of a base and a fatty acid at more than 7 percent of the total composition. Examples of suitable bases include potassium hydroxide, monoethanol amine and diethanolamine. Examples of suitable carboxylic acids are the aromatic carboxylic acids and $C_{4-16}$ dibasic carboxylic acids. The composition has a basic pH.

DETAILED DESCRIPTION OF THE INVENTION

A novel, synthetic post-pickle fluid is provided which is useful for treating metal. In general, metal to be treated is contacted with the synthetic post-pickle fluid. The synthetic post-pickle fluid provides corrosion resistance to the treated metal and also acts as a lubricant in further processing of the metal. The fluid also provides excellent scratch and gouge protection and provides improved metal cleanliness. Furthermore, the synthetic post-pickle fluid is a non-hydrocarbon formulation. This provides an added advantage of fewer problems encountered in its use, e.g., handling and disposal problems. It has also been discovered that lower processing temperatures are required for using the present composition.

In the preferred embodiment, the synthetic post-pickle fluid comprises an aqueous solution of from about 1 to about 6 percent by weight of the total composition of an aromatic carboxylic acid, a dibasic carboxylic acid having 4–16 carbon atoms or a mixture of these acids, and from about 2 to about 10 percent by weight of a base. Examples of suitable aromatic acids include: benzoic acid, O-chlorobenzoic acid, phthalic acid, isophthalic acid and terephthalic acid. Phthalic acid anhydride may be utilized in place of phthalic acid. Examples of suitable dibasic carboxylic acids include: succinic acid, adipic acid, azelaic acid, crude azelaic acid, sebacic acid, Du Pont's DBD (trademark for a $C_{10}$–$C_{12}$ mixture of dibasic carboxylic acids) and a blend which is 12 percent by weight of crude azelaic and 88 percent by weight of a blend of fatty acids which is primarily oleic acid. The preferred bases include KOH, monoethanolamine and diethanolamine. It is preferred that KOH be present in each composition. As used herein, KOH is generally a 45 percent strength aqueous solution. Thus, 6 percent by weight of the total composition of KOH refers to utilizing 6 parts out of 100 parts of a 45 percent KOH solution. It is understood that other strength solutions of KOH are possible and the amount utilized will be adjusted so that an equivalent amount of moles of KOH is present in the final composition. The base is utilized to form a soap and to provide a pH of from about 9 to about 11.3, preferably from about 9.5 to about 10.5.

In addition to the carboxylic acid and base, the composition also preferably contains a fatty acid or mixture of fatty acids. The fatty acids along with the carboxylic acid and base form a soap composition. Examples of fatty acids which may be utilized are: oleic acid, linseed fatty acids, coconut fatty acids, Century CD fatty acids (trademark of Wallace and Tiernan Inc.), Emery 929 (tradename of Emery Industries Inc.), Unitol MO-5, Westvaco 1550 Diacid (tradename of Westvaco), Dimer Acid, 3020 Dimer Acid, 1028 Dimer Acid and 1022 Dimer Acid (tradenames of Emery Industries Inc.). The fatty acids may be used singly or in combination with one another. When the synthetic post-pickle fluid contains a fatty acid, it is present at from about 1 to about 10 percent by weight of the total composition.

In addition to the above ingredients, the synthetic post-pickle fluid also preferably contains thickeners or viscosity control agents. When present, the viscosity control agents comprise about 0.1 to about 6 percent, preferably about 0.1 to about 3 percent, by weight of the total composition. The viscosity control agents are added to the synthetic post-pickle fluid composition so that the composition has a viscosity of from about 27 to about 250 seconds when tested with a Zahn number 1 cup. Examples of viscosity control agents which may be utilized include: isopropyl alcohol, diethylene glycol, boric acid, caprylic acid, butyl acid phosphate, Carbowax 1000, Carbowax 6000, and Ucon 50 HB 170. (Carbowax and Ucon are trademarks of Union Carbide Corporation.) The viscosity control agents may be used singly or as a mixture of more than one.

In addition to the above ingredients, the synthetic post-pickle fluid also advantageously contains one or more extreme pressure additives. When the extreme pressure additives are present, they comprise from about 0.5 to about 6 percent, preferably about 1 to about 5 percent, by weight of the composition. Examples of suitable extreme pressure additives are: sulfurized oleic acid, Emery 2408 (trademark of Emery Industries, Inc.) and other Dimer acid esters.

An optional component of the composition of this invention is a chelating agent. An example of a chelating agent is ethylenediaminetetraacetic acid. If present, it preferably comprises from about 0.1 to about 0.2 percent by weight of the synthetic post-pickle fluid composition. The remainder of the composition is water. It is preferred that water comprise from about 73 to about 83 percent by weight of the composition.

Thus, according to the preferred embodiment, the synthetic post-pickle fluid has the following composition:

| | generally | preferably |
|---|---|---|
| water | 61.8-9-7% | 73-83% |
| base | 2-10% | 2-10% |
| fatty acid | 0-10% | 1-10% |
| carboxylic acid | 1-6% | 1-6% |
| viscosity control agent | 0-6% | 0.3-3% |
| extreme pressure additive | 0-6% | 1-5% |
| chelating agent | 0-1.0% | 0.2-0.2% |

In another embodiment of the present invention, it has been discovered that a synthetic post-pickle fluid composition can also be prepared without the carboxylic acid component. It has been found that when the fatty acid component comprises from about 7 to about 10 percent by weight of the total composition and the remaining parameters, namely pH and viscosity, and the other ingredients are the same, then the aromatic carboxylic acid and the dibasic carboxylic acid can be eliminated from the composition. In this embodiment, the synthetic post-pickle fluid has the following composition:

| | generally | preferably |
|---|---|---|
| water | 67.8-91% | 73-83% |
| base | 2-10% | 2-10% |
| fatty acid | 7-10% | 7-10% |
| viscosity control agents | 0-6% | 0.1-3% |
| extreme pressure additives | 0-1% | 1-5% |
| chelating agent | 0-1.0% | 0.2-0.2% |

The synthetic post-pickle fluid is used to treat metal to provide corrosion resistance to the metal and to act as a lubricant for further processing. The metal to be treated is contacted with the synthetic post-pickle fluid composition in any conventional manner. For example, the composition can be utilized in a conventional pickler through a mandrel applicator or a conventional pickler-upcoiler to coat the metal. It is understood that the composition of the present invention is used to treat metal in any manner well known in the art.

The details of the present invention are further illustrated by the following examples. Unless otherwise stated, all parts and percents referred to herein and in the appended claims are by weight. Unless otherwise stated, viscosity is measured using a Zahn #1 cup and the measure of lubrication is determined by using a Falex #8 pin.

EXAMPLE 1

A synthetic post-pickle fluid was prepared by mixing 83 parts of water, 6 parts of benzoic acid, 2 parts of a 45 percent aqueous solution of potassium hydroxide, 1.5 parts of oleic acid, 0.5 parts of sulfurized oleic acid as an extreme pressure additive, 4 parts of monoethanolamine, and 3 parts of isopropyl alcohol to regulate the viscosity. The composition had the following properties: the pH was 9.6; the viscosity was 34 seconds; and the measure of lubrication was 2400/3000 (54). This fluid provided good corrosion resistance and lubrication to metal which had been treated with it.

EXAMPLE 2

A synthetic post-pickle fluid was prepared as described in Example 1 with the following exceptions: the sulfurized oleic acid was deleted and 2 parts of the fatty acid Westvaco 1550 Diacid was utilized in place of the oleic acid. The pH of this mixture was 9.8. The viscosity was 27.5 seconds, and the measure of lubrication was 2250/3000 (60). This fluid also imparted good corrosion resistance and lubrication to the treated metal.

EXAMPLE 3

A synthetic post-pickle fluid was prepared as described in Example 1, with the following exceptions: 82 parts of water, 2 parts of oleic acid, and 1 part of sulfurized oleic acid were utilized instead of the amounts indicated in Example 1. The composition had a pH of 9.5, a viscosity of 28 seconds, and a measure of lubrication of 2200/3000 (60). This fluid provided good corrosion resistance and lubrication to treated metal.

EXAMPLES 4 and 5

Synthetic post-pickle fluids were prepared which had the compositions and properties as follows:

| | Ex. 4 | Ex. 5 |
|---|---|---|
| water | 83% | 83% |
| benzoic acid | 6 | 6 |
| KOH (45%) | 2 | 2 |
| oleic acid | 2 | 1 |
| sulfurized oleic acid | — | 1 |
| monoethanolamine | 4 | 4 |
| diethylene glycol | 3 | 3 |
| pH | 9.7 | 9.8 |
| viscosity (seconds) | 70 | 104 |
| lubrication 2375/3000 (55) | 2675/3000 (70) | |

Both of these fluids imparted good corrosion resistance and lubrication to metal.

EXAMPLES 6—12

Synthetic post-pickle fluids were prepared which had the following compositions and properties. Metal contacted with each of these compositions showed good corrosion resistance and was lubricated for further processing.

| | Ex. 6 | Ex. 7 | Ex. 8 | Ex. 9 | Ex. 10 | Ex. 11 | Ex. 12 |
|---|---|---|---|---|---|---|---|
| Water | 78% | 78% | 77.5% | 77.5% | 80% | 77% | 76% |
| Benzoic Acid | 6 | 6 | 6 | 6 | 6 | 6 | 6 |
| KOH (45%) | 2 | 2 | 5 | 5 | 2 | 5 | 5 |
| Oleic Acid | 1 | 1 | 1 | 1 | 2 | 1 | — |

-continued

| | Ex. 6 | Ex. 7 | Ex. 8 | Ex. 9 | Ex. 10 | Ex. 11 | Ex. 12 |
|---|---|---|---|---|---|---|---|
| Dimer Acid | 5 | — | — | — | — | — | — |
| Coconut Fatty Acids | — | — | — | — | — | 2 | — |
| Century CD Fatty Acids | — | — | — | — | — | — | 2 |
| Sulfurized Oleic Acid | 1 | 1 | 1 | 1 | — | — | 1 |
| Emery 2908 | — | 5 | — | — | 1 | — | — |
| Dimer Acid Ester | — | — | 2 | 2 | 2 | 2 | 2 |
| Monoethanolamine | 4 | 4 | — | — | 4 | — | — |
| Diethanolamine | — | — | 4 | 4 | — | 4 | 4 |
| Diethylene Glycol | 3 | 3 | 3 | 3 | 3 | 3 | 3 |
| Carbowax 1000 | — | — | 0.5 | — | — | — | — |
| Carbowax 6000 | — | — | — | 0.5 | — | — | — |
| pH | 9.95 | 10.1 | 9.65 | 10.0 | 9.8 | 9.9 | 9.5 |
| Viscosity (seconds) | 29.75 | 28 | 28 | 29 | 29 | 27 | 28.2 |
| Lubrication | 2250/3000 (52) | 2580/3000 (65) | 2400/3000 (55) | 2250/3000 (50) | 2450/3000 | 2350/3000 | 2450/3000 |

EXAMPLES 13–15

Synthetic post-pickle fluids were prepared which did not contain an aromatic carboxylic acid or a dibasic carboxylic acid. Metal treated with these fluids had good corrosion resistance and were lubricated for further processing. These fluids had the following compositions and properties:

| | Ex. 13 | Ex. 14 | Ex. 15 |
|---|---|---|---|
| water | 83 | 83 | 81.3 |
| KOH (45%) | 2 | 2 | 4 |
| oleic acid | 7 | 7 | 10 |
| sulfurized oleic acid | 1 | 1 | 1 |
| monoethanolamine | — | 4 | 3 |
| diethanolamine | 4 | — | — |
| diethylene glycol | 3 | 3 | 1 |
| caprylic acid | — | — | 0.5 |
| boric acid | — | — | 0.1 |
| EDTA | — | — | 0.1 |
| pH | 10.3 | 11.3 | 11.0 |
| viscosity (seconds) | 29 | 29 | 90 |
| lubrication | 2625/3000 (53) | 2250/3000 (45) | — |

EXAMPLES 16–17

Synthetic post-pickle fluids were prepared which provided treated metal with good corrosion resistance and lubricated it, and which had the following composition and properties:

| | Ex. 16 | Ex. 17 |
|---|---|---|
| water | 81.5 | 82.9 |
| KOH (45%) | 4 | 2 |
| benzoic acid | 6 | 6 |
| Unitol MO-5 | — | 1 |
| sulfurized oleic acid | 1 | 1 |
| monoethanolamine | — | 4 |
| diethanolamine | 4 | — |
| diethylene glycol | 3 | 6 |
| butyl acid phosphate | 0.5 | — |
| EDTA | — | 0.1 |
| pH | 9.6 | 10.1 |
| viscosity (seconds) | 33 | 64 |
| lubrication | 2500/3000 | — |

EXAMPLES 18–24

Synthetic post-pickle fluids were prepared using a dibasic carboxylic acid instead of an aromatic carboxylic acid. Metal treated with each of these fluids exhibited good corrosion resistance and was lubricated. The fluids had the following compositions and properties:

| | Ex. 18 | Ex. 19 | Ex. 20 | Ex. 21 | Ex. 22 | Ex. 23 | Ex. 24 |
|---|---|---|---|---|---|---|---|
| Water | 80.5% | 80.15% | 80.8% | 80.5% | 80.8% | 80.5% | 75.8% |
| KOH (45%) | 8.5 | 8.75 | 9.1 | 8.5 | 9.1 | 9.1 | 5.6 |
| Azelaic Acid | 6 | 6 | 5.0 | 5 | 5 | 5 | 5 |
| Oleic Acid | 1 | — | 3 | — | 3 | — | 6 |
| Emery 929 | — | 1 | — | 4 | — | — | — |
| Corn Oil Fatty Acids | — | — | — | — | — | 3 | — |
| Westvaco 1550 Diacid | — | — | — | — | — | — | 1 |
| Sulfurized Oleic Acid | 1 | 1 | 1 | 1 | 3 | 1 | 1 |
| Monoethanolamine | — | — | — | — | — | — | 3 |
| Diethylene Glycol | 3 | 3 | — | — | — | — | 3 |
| Boric Acid | — | — | 0.1 | 0.5 | 0.1 | 0.1 | — |
| Caprylic Acid | — | — | 0.1 | — | 0.1 | 0.1 | 0.1 |
| Ucon 50 HB 170 | — | — | 0.8 | 0.4 | 0.8 | 0.8 | — |
| EDTA | — | — | 0.1 | 0.1 | 0.1 | 0.1 | 0.1 |
| pH | 9.8 | 9.9 | 9.5 | 10.4 | 9.8 | 9.6 | 9.5 |
| Viscosity (seconds) | 250 | 151 | 121 | 128 | 142 | 78 | 128 |
| Lubrication | 2400/3000 | — | 3000/3000 | — | — | — | — |

EXAMPLES 25–33

Synthetic post-pickle fluids were prepared which had the following compositions and properties. Each of these fluids imparted good corrosion resistance to treated metal and acted as a lubricant for further processing of the metal. The fluids had the following compositions and properties:

| | Ex. 25 | Ex. 26 | Ex. 27 | Ex. 28 | Ex. 29 | Ex. 30 | Ex. 31 | Ex. 32 | Ex. 33 |
|---|---|---|---|---|---|---|---|---|---|
| Water | 79.3% | 75.8% | 81.1% | 79.9% | 83% | 80.4% | 73.15% | 74.2% | 73.8% |
| KOH (45%) | 4.5 | 4.5 | 8.8 | 3.4 | 3.5 | 4.8 | 7.0 | 5.5 | 6.0 |
| Azelaic Acid | 3 | 3 | 5 | 2 | 6 | 6 | 4.08* | 4.08* | 4.08* |
| Unitol MO-5 | 8.0 | 8.0 | — | 8.0 | — | — | 7.92* | 7.92* | 7.92* |
| 1028 Dimer Acid | — | — | — | — | — | — | 2.0 | — | 2.0 |
| Corn Oil Fatty Acids | — | — | 3.0 | — | — | — | — | — | — |
| 3020 Dimer Acid | — | — | — | 1.0 | — | — | — | — | — |
| Linseed Fatty Acids | — | — | — | — | 1 | 1 | — | — | — |
| Sulfurized Oleic Acid | 1 | 1 | 1 | 1 | 1 | 1 | 1 | 1 | 1 |
| Monoethanolamine | 3 | 3 | — | 3 | 4 | 4 | 3 | 2.6 | 3 |
| Diethylene Glycol | — | 3 | — | — | — | — | — | 3.0 | — |
| Boric Acid | — | — | 0.1 | — | — | — | — | — | — |
| Caprylic Acid | — | — | 0.7 | 0.5 | — | — | 0.65 | — | 1.0 |
| Ucon 50 HB 170 | 1.4 | 1.5 | 0.8 | 1.0 | 0.3 | 0.6 | 1.0 | 1.5 | 1.0 |
| EDTA | 0.2 | 0.2 | 0.1 | 0.2 | 1.0 | 0.2 | 0.2 | 0.2 | 0.2 |
| pH | 9.8 | 9.8 | 9.7 | 9.8 | 10.1 | 10.1 | 10.4 | 10.4 | 10.3 |
| Viscosity (seconds) | 144 | 110 | 35 | 121 | 65 | 81 | 86 | 56 | 78 |
| Lubrication | 2650/3000 | — | 2500/3000 | 2700/3000 | — | — | 2250/3000 | — | 2450/3000 |

*The azelaic acid was added as azelaic acid and in a mixture with 12% crude azelaic acid and 88% fatty acid blend which is mainly oleic acid.

EXAMPLES 34–43

Synthetic post-pickle fluids were prepared using a mixture of a dibasic carboxylic acid and an aromatic acid or as a mixture of dibasic carboxylic acids. These fluids provided treated metal with good corrosion resistance and also lubricated them. The fluids had the following compositions and properties:

| | Ex. 34 | Ex. 35 | Ex. 36 | Ex. 37 | Ex. 38 | Ex. 39 | Ex. 40 | Ex. 41 | Ex. 42 | Ex. 43 |
|---|---|---|---|---|---|---|---|---|---|---|
| Water | 81.5% | 79.6% | 75.3% | 75.2% | 76.8% | 77.4% | 77.8% | 78.3% | 77.5% | 78.975% |
| KOH (45%) | 4.0 | — | 6.4 | 6.1 | 4.5 | 4.7 | 4.3 | 3.5 | 4.7 | 4.5 |
| Benzoic Acid | 2.0 | 2.0 | 2.0 | 2.0 | — | — | — | — | — | 3.0 |
| Phthalic Acid | — | — | — | — | — | 3.0 | — | — | 3.0[3] | — |
| Terephthalic Acid | — | — | — | — | — | — | 3.0 | — | — | — |
| DuPont DBD | — | — | — | — | 3.0 | — | — | — | — | — |
| Sebacic Acid | — | — | — | — | — | — | — | 3.0 | — | — |
| Azelaic Acid | 3.0 | 3.48[1] | 3.9[1] | 3.9[2] | 1.2[2] | 0.84[2] | 0.84[2] | 0.96[2] | 0.96[2] | 1.08[2] |
| Oleic Acid | 3.5 | 3.52[1] | 6.6[1] | — | — | — | — | — | — | — |
| Unitol MO-5 | — | — | — | 6.6[2] | 8.8[2] | 6.16[2] | 6.16[2] | 7.04[2] | 7.04[2] | 7.92[2] |
| Sulfurized Oleic Acid | 1.0 | 1.0 | 1.0 | 1.0 | 1.0 | 1.0 | 1 | 1 | 1 | 1 |
| Monoethanolamine | 4.0 | 4.5 | 3.6 | 3.6 | 2.5 | 2.5 | 2.5 | 3 | 2.5 | 2 |
| Diethylene Glycol | — | 4.5 | 0.5 | 0.5 | 1.5 | 3.0 | 3.0 | 1.5 | 1.8 | — |
| Ucon 50 HB 170 | 0.8 | 0.3 | 0.4 | 0.8 | 1.2 | 1.2 | 1.2 | 1.5 | 1.2 | 1.3 |
| Boric Acid | 0.1 | 1.0 | 0.2 | 0.2 | — | — | — | — | — | 0.025 |
| EDTA | 0.1 | 0.1 | 0.1 | 0.1 | 0.2 | 0.2 | 0.2 | 0.2 | 0.2 | 0.2 |
| pH | 9.65 | 9.8 | 9.7 | 9.8 | 9.8 | 9.9 | 9.7 | 9.8 | 10.0 | 9.8 |
| Viscosity (seconds) | 165 | 70 | 85 | 143 | 192 | 123 | 160 | 120 | 104 | 91 |
| Lubrication | 2800/3000 | — | 2720/3000 | 2700/3000 | — | 2650/3000 | 2550/3000 | 3000/3000 (68) | 3000/3000 (70) | 2250/3000 |

[1]Azelaic acid was added as azelaic acid and a mixture of crude azelaic acid (12%) and oleic acid (88%). Oleic acid was added only by this mixture.
[2]Azelaic acid was added as azelaic acid and a mixture of crude azelaic acid (12%) and Unitol MO-5 (88%). Unitol MO-5 was added only by this mixture.
[3]Phthalic anhydride was used in place of phthalic acid.

While the invention has been described in connection with specific embodiments thereof, it will be understood that it is capable of further modifications. This application is intended to cover any variations, uses or adaptations of the invention following, in general, the principles of the invention and including such departures from the present disclosure as come within known and customary practice within the art to which the invention pertains.

What is claimed is:

1. A synthetic post-pickle fluid consisting essentially of an aqueous solution of from about 1 to about 6 percent of a dibasic carboxylic acid selected from the group consisting of azelaic acid, adipic acid, succinic acid, sebacic acid and mixtures thereof and from about 2 to about 10 percent of a base selected from the group consisting of potassium hydroxide, monoethanolamine, diethanolamine, and mixtures thereof.

2. The synthetic post-pickle fluid of claim 1 which further includes from about 1 to about 10 percent of a fatty acid or a mixture of two or more fatty acids.

3. The synthetic post-pickle fluid of claim 1 or 2 which also includes from about 0.01 to about 6 percent of a viscosity control agent or a mixture of two or more viscosity control agents.

4. The synthetic post-pickle fluid of claim 1 or 2 which further includes from about 0.5 to about 6 percent of an extreme pressure additive or a mixture of two or more extreme pressure additives.

5. The synthetic post-pickle fluid of claim 3 which further includes from about 0.5 to about 6 percent of an extreme pressure additive or a mixture of two or more extreme pressure additives.

6. The synthetic post-pickle fluid of claim 1 which consists essentially of from about 1 to about 6 percent of said dibasic carboxylic acid, from about 2 to about 10 percent of said base, from about 1 to about 10 percent of a fatty acid or a mixture of two or more fatty acids, from about 0.1 to about 6 percent of a viscosity control agent or a mixture of two or more viscosity control agents, and from about 0.5 to about 6 percent of an extreme pressure additive or a mixture of two or more extreme pressure additives.

7. The synthetic post-pickle fluid of claim 6 which consists essentially of from about 0.1 to about 3 percent of a viscosity control agent or a mixture of two or more viscosity control agents and from about 1 to about 5 percent of an extreme pressure additive or a mixture of two or more extreme pressure additives.

8. A method of treating metal which has been treated in a pickling bath to impart corrosion resistance to the treated metal and to lubricate it which comprises contacting said metal with the synthetic post-pickle fluid of claim 1 or 2.

9. A method of treating metal which has been treated in a pickling bath to impart corrosion resistance to the treated metal and to lubricate it which comprises contacting said metal with the synthetic post-pickle fluid of claim 5, 6, or 7.

10. The synthetic post-pickle fluid of claim 1, 2, 6 or 7 wherein said dibasic carboxylic acid is azelaic acid.

11. The synthetic post-pickle fluid of claim 1, 2, 6 or 7 wherein said base is potassium hydroxide.

* * * * *